US010111295B1

(12) United States Patent
Belliveau

(10) Patent No.: US 10,111,295 B1
(45) Date of Patent: Oct. 23, 2018

(54) METHODS AND IMPROVEMENTS TO SPECTRAL MONITORING OF THEATRE LIGHTING DEVICES

(71) Applicant: Richard S. Belliveau, Austin, TX (US)

(72) Inventor: Richard S. Belliveau, Austin, TX (US)

( * ) Notice: Subject to any disclaimer, the term of this patent is extended or adjusted under 35 U.S.C. 154(b) by 0 days.

(21) Appl. No.: 15/786,360

(22) Filed: Oct. 17, 2017

(51) Int. Cl.

| | |
|---|---|
| ***H05B 37/02*** | (2006.01) |
| ***H05B 33/08*** | (2006.01) |
| ***F21V 21/14*** | (2006.01) |
| ***F21V 5/00*** | (2018.01) |
| *F21Y 115/10* | (2016.01) |
| *F21W 131/406* | (2006.01) |
| *F21V 23/00* | (2015.01) |
| *F21V 15/01* | (2006.01) |

(52) U.S. Cl.
CPC ..... *H05B 33/0863* (2013.01); *F21V 5/008* (2013.01); *F21V 21/14* (2013.01); *H05B 33/0851* (2013.01); *H05B 37/0272* (2013.01); *F21V 15/01* (2013.01); *F21V 23/00* (2013.01); *F21W 2131/406* (2013.01); *F21Y 2115/10* (2016.08)

(58) Field of Classification Search
CPC ..... H05B 37/0272; F21V 15/01; F21V 23/00
USPC ..... 315/293; 362/362
See application file for complete search history.

(56) References Cited

U.S. PATENT DOCUMENTS

| | | | | |
|---|---|---|---|---|
| 4,392,187 | A | 7/1983 | Bornhorst | |
| 4,894,760 | A | 1/1990 | Callahan | |
| 4,962,687 | A | 10/1990 | Belliveau et al. | |
| 5,282,121 | A | 1/1994 | Bornhorst et al. | |
| 5,521,708 | A | 5/1996 | Beretta | |
| 6,211,627 | B1 | 4/2001 | Callahan | |
| 6,333,602 | B1 * | 12/2001 | Kayser ..... | H05B 37/03 315/112 |
| 6,570,348 | B2 | 5/2003 | Belliveau | |
| 6,621,239 | B1 * | 9/2003 | Belliveau ..... | H05B 33/0854 315/112 |
| 6,683,423 | B2 | 1/2004 | Cunningham | |
| 7,014,336 | B1 | 3/2006 | Ducharme et al. | |
| 7,119,902 | B2 | 10/2006 | Beaumont | |
| 7,148,632 | B2 | 12/2006 | Berman et al. | |
| 7,227,634 | B2 | 6/2007 | Cunningham | |
| 7,728,845 | B2 | 6/2010 | Holub | |

(Continued)

FOREIGN PATENT DOCUMENTS

WO WO 2016206996 A1 12/2016

*Primary Examiner* — Thuy Vinh Tran
(74) *Attorney, Agent, or Firm* — Walter J. Tencza, Jr.

(57) ABSTRACT

An apparatus including a theater lighting device including a lamp housing; a base housing; and an internal spectral sensor. The lamp housing is rotationally mounted to the base housing; and includes a plurality of light sources, and lenses which cooperate to project a final output light; and wherein residual light is received by the internal spectral sensor from internal reflections of a first lens of the plurality of lenses and the residual light is converted to spectral data. The spectral sensor is a multispectral filter array type. The theater lighting device further includes a microprocessor; and a memory, wherein the memory stores a first set of data for a plurality of electronically adjustable parameters of the theater lighting device. The microprocessor is programmed to receive a first command and in response put the theater lighting device in a first state.

52 Claims, 10 Drawing Sheets

(56) References Cited

U.S. PATENT DOCUMENTS

| | | | | |
|---|---|---|---|---|
| RE41,726 | E * | 9/2010 | Belliveau | H05B 41/2928 315/112 |
| 7,923,935 | B2 | 4/2011 | Archenhold et al. | |
| 7,939,793 | B2 * | 5/2011 | Rains, Jr. | F21S 2/00 250/205 |
| 9,131,548 | B2 | 9/2015 | Lee et al. | |
| 9,435,497 | B2 | 9/2016 | Kallas et al. | |
| 9,593,830 | B2 | 3/2017 | Conti et al. | |
| 2006/0133079 | A1 | 6/2006 | Callahan | |
| 2012/0068608 | A1 | 3/2012 | Covaro et al. | |
| 2014/0022780 | A1 | 1/2014 | Roberge et al. | |
| 2014/0204841 | A1 | 7/2014 | Delgado et al. | |

* cited by examiner

METHODS AND IMPROVEMENTS TO SPECTRAL MONITORING OF THEATRE LIGHTING DEVICES

FIELD OF THE INVENTION

This invention relates to improved methods and apparatus concerning multiparameter theatre lighting fixtures.

BACKGROUND OF THE INVENTION

Multiparameter theatre lighting fixtures are lighting fixtures, which illustratively have two or more individually remotely adjustable parameters such as focus, color, image, position, or other light characteristics. Multiparameter lighting fixtures are widely used in the lighting industry because they facilitate significant reductions in overall lighting system size and permit dynamic changes to the final lighting effect. Applications and events in which multiparameter lighting fixtures are used to great advantage include showrooms, television lighting, stage lighting, architectural lighting, live concerts, and theme parks.

Multiparameter theatre lighting fixtures are commonly constructed with a lamp housing that may pan and tilt in relation to a base housing so that light projected from the lamp housing can be remotely positioned to project on a stage surface. The lamp housing of the multiparameter light contains the optical components such as a lamp and may include color filters for varying the color of the projected light. Commonly a plurality of multiparameter lights are controlled by an operator from a central controller. The central controller is connected to communicate with the plurality of multiparameter lights via a communication system.

U.S. Pat. No. 4,962,687 to Belliveau, describes a variable color lighting system and instrument that uses an additive color mixing method to fade from one color to another. The lighting instrument is comprised of three lamps each emitting a different wavelength of light in the colors of red, green and blue that can be added together to vary the color of the projected light.

The use of dichroic filters to color the light projected by a multiparameter theatre lighting instrument is known in the art. U.S. Pat. No. 4,392,187 to Bornhost, discloses the use of dichroic filters in a multiparameter light. Bornhorst discloses "The dichroic filters transmit light incident thereon and reflect the complement of the color of the transmitted beam. Therefore, no light is absorbed and transformed to heat as found in the prior art use of celluloid gels. The use of a relatively low power projection lamp in lights 30 and 110 substantially reduces the generation of infrared radiation which causes high power consumption and heat buildup within prior art devices." While the use of color wheels that support multiple wavelengths of dichroic filters to color the light of a multiparameter stage light is still in common practice, it is also common practice to construct a multiparameter light having variable density dichroic filter flags that gradually color the light using a subtractive color method. The subtractive color method may use the dichroic filter flag colors of cyan, magenta and yellow to gradually and continuously vary the color of today's multiparameter stage light producing a pleasing color fade when visualized by an audience. The gradual and continuous varying of cyan, magenta and yellow in the light path of a multiparameter light is referred to as "CMY color mixing" in the theatrical art.

Present day light sources for theatrical instruments are primarily comprised of light emitting diodes (LEDs). One such theatrical instrument using a high power white LED light source is the SolaWash 2000 by High End Systems of Austin, Tex. found at https://www.highend.com/products/lighting/solawash. This high power white LED lighting instrument varies the color of the projected light using a CMY color mixing system, which is known in the art.

Theatrical Lighting Designers are becoming increasingly critical of the requirement that the color(s) and intensity of the light emitted by a first theatre lighting device is visually and measurably the same as the light emitted by a second theatre lighting device. The advent of cost effective smart phone spectrometers in the hands of savvy lighting designers now allows the designers to directly compare and capture data by spectrometer for each theatre lighting device and forward that comparison data results to the manufacture sometimes with complaints. While it is virtually impossible to obtain a measured spectrum that is identical from theatre lighting device to theatre lighting device manufacturers do strive to make improvements to their manufacturing and specification process.

The intensity and color differences of each theatrical lighting device is comprised of many different light source tolerances, optical filter tolerances, mechanical tolerances, electronic component tolerances, and lens and antireflective coating tolerances. Unfortunately the human eye is extremely sensitive to color differences in side by side comparisons which is a common installation practice of theatrical lighting devices when used during a theatrical event. The human eye can differentiate approximately ten million colors but only in a side by side comparison. Studies on how sensitive the human eye is regarding color differences of light sources have been previously been conducted. For example, see "Paper #51 Just Perceivable Color Differences between Similar Light Sources in Display Lighting Applications", Narendran, Vasconez, Boyce, and Eklund, Lighting Research Center, Rensselaer Polytechnic Institute.

U.S. Pat. No. 5,282,121 to Bornhorst discloses an intensity feedback device 224 and a color sensor or spectrum analyzer 280 as sensor components of the apparatus disclosed in FIG. 7.

As stated in Bornhorst '121: "A light-sensitive electrical device, such as a photo diode or other suitable transducer can be used to sample the beam after it has been subjected to dimming by an intensity control mechanism, and provides intensity feedback signals to the local processor 285 for intensity control. In one embodiment, shown in FIG. 7, the intensity feedback device 224 is positioned to sample the intensity of light after the intensity control wheel 222. The intensity feedback arrangement allows a luminaire to produce a specified level of illumination. Intensity feedback may be selectively disabled in the operating system software controlling the local processor, for example in instances in which the feedback sensor might be in the shadow of a gobo or other projected image. Color Matching. A problem which arises in some applications involves color mismatch between luminaires. Lamp color calibration can vary with lamp type and can also change with time making it difficult to achieve precise color match among the luminaires of a system. To address this problem, the system according to the invention includes a color sensor or spectrum analyzer 280 for quantifying beam color. It is implemented with a linear variable filter 280*a*, FIG. 7, which is located to sample the beam after it has been subjected to coloring by the beam color system 221. For this purpose, it may be located to receive a sampled portion of the beam which passes through an aperture 236*a* of mirror 236." (Bornhorst '921, col. 17, In. 41-col. 18, In. 2).

U.S. Pat. No. 6,211,627 to Callahan discloses: "A light/color meter provided with a data link link or interface to one can link to the corrector so that the beam can be automatically conformed to the specified values by appropriate adjustment of the scrolls, discs, and/or dowser". (Callahan '627, col. 21, In. 21-col. 21, In. 25).

"The light/color meter and/or the 'corrector' can communicate via a hard-wired serial channel and/or a broadcast link. The measured values can be read at a location remote from the light meter(s), including at the fixture, and the user can actuate the scrolls, discs, or dowser from a variety of remote locations." (Callahan '627, col. 21, Ins. 25-31).

U.S. Pat. No. 7,014,336 to Ducharme discloses: " . . . the calibration system includes a lighting fixture (2010) that is connected to a processor (2020) and which receives input from a light sensor or transducer (2034). The processor (2020) may be processor (316) or may be an additional or alternative processor. The sensor (2034) measures color characteristics, and optionally brightness, of the light output by the lighting fixture (2010) and/or the ambient light, and the processor (2020) varies the output of the lighting fixture (2010). Between these two devices modulating the brightness or color of the output and measuring the brightness and color of the output, the lighting fixture can be calibrated where the relative settings of the component illumination sources (or processor settings (2020)) are directly related to the output of the fixture (2010) (the light sensor (2034) settings). Since the sensor (2034) can detect the net spectrum produced by the lighting fixture, it can be used to provide a direct mapping by relating the output of the lighting fixture to the settings of the component LEDs." (Ducharme '336, col. 15, In. 46-col. 15, In. 65).

U.S. Pat. No. 5,282,121 to Bornhorst shows the position of light sensitive electrical device 224 that may be positioned in the shadow of a gobo or other projected image. (Bornhorst, col., 17, Ins. 50-55). Further a second color sensor or spectrum analyzer 280 may be located as to intercept light through an aperture 236*a* of mirror 236. (Bornhorst, '121, col. 17, In. 63-col. 18, In. 2)

It is known in the art that the light beams created by theatrical lights are seldom perfectly homogenous across the entire projected light. There can be differences in Correlated Color Temperature (CCT) by as much as two hundred and fifty degrees Kelvin from the center to the edge of the projected light beam. Unfortunately a sensor placed in the middle of beam is subject to only being able to measure a center sample of the light beam. The center of the light beam may have a visible significant color difference compared to the edge of the light beam. In this case any calibration or reference of the overall average color of the projected light of the theatre device would suffer the corresponding inaccuracies.

It is also know by the disclosure of U.S. Pat. No. 5,282,121 to Bornhorst the method of suspending a spectral sensor in the center of a theatrical light beam may cause the sensor to be positioned in a shadow or image. Finally a sensor positioned in the center of a light beam is subject to sensing only light from the center area of the light beam.

SUMMARY OF THE INVENTION

One or more embodiments of the present invention provide theatrical lighting devices that are comprised of spectral sensors that can detect and regulate the spectral composition and intensity of the light output of a theatre lighting device while providing reports on the performance and quality of the light emitted by the theatrical lighting device over its lifetime. This is advantageous to a theatrical lighting device manufacturer and a theatrical lighting designer.

One or more embodiments of the present invention provide an innovative way to apply an integrated spectral sensor as close to the final output of the projected light of a theatre device, yet also finds a way to homogenize the light received by the spectral sensor, without causing additional distracting artifacts in the projected beam light path.

Another object of the present invention in one or more embodiments is to calibrate the internal spectral sensor to an external spectral sensor during the manufacturing process.

Another object of the present invention in one or more embodiments is to report a light producing fault to a user of a central control system when recognized by the internal spectral sensor that the theatre light of the invention is not performing as expected during a show or rehearsal.

Another object of the present invention in one or more embodiments is report to the central controller the available color coordinates of the theatre lighting device of the invention so that the central controllers can map the available color coordinates.

Another object of the present invention in one or more embodiments is a "release" calibration method that allows an operator of the central controller to temporarily release a pre-specified calibration to allow the full and maximum output of the theatre light of the invention.

Another object of the present invention in one or more embodiments is show a comparison of the calibrated influenced light output to the original uncalibrated light output so a technician can determine if it is justifiable to calibrate the original intensity and wavelength.

Another object of the present invention in one or more embodiments is to calibrate the light source of the theatre light of the invention by altering the resultant intensity and or color spectrum by introducing color filter medial into the light path.

Another object of the present invention in one or more embodiments is to notify an operator to the decline of intensity of one or more of the light sources that may allow the operator to remove or repair the light source before a catastrophic failure during a theatrical event.

Another object of the present invention in one or more embodiments is to show a history of the intensity and spectral performance of the light sources of the theatre light of the one or more embodiments of the present invention that is stored in the memory of the theatre light.

Another object of the present invention in one or more embodiments is to transmit history data of the intensity and spectral performance of the light sources of a theatre light to a central control system.

Another object of the present invention in one or more embodiments is to establish a first predetermined state of the theater lighting device. The theatre lighting device responsive to a first command to place the theatre light into a predetermined first state for setting the parameters of the theatre lighting device to facilitate spectral and or intensity measurements.

In at least one embodiment an apparatus is provided comprising a theatre lighting device comprising a lamp housing; a base housing; and an internal spectral sensor. The lamp housing may be rotationally mounted to the base housing. The lamp housing may be comprised of a plurality of light sources, and a plurality of lenses wherein the plurality of light sources and the plurality of lenses cooperate to project a final output light; and wherein residual light is received by the internal spectral sensor from internal reflections of a first lens of the plurality of lenses and the residual light is converted to spectral data.

The spectral sensor may be a multispectral filter array type. The theatre lighting device may be further comprised of a microprocessor; and a memory. The memory may store a first set of data for a plurality of electronically adjustable parameters of the theatre lighting device. The microprocessor may be programmed to receive a first command and in response to the first command to put the theatre lighting device in a first state in which the plurality of electronically adjustable parameters are set in accordance with the first set of data. The apparatus may be further comprised of an external spectral sensor which is external to the theatre lighting device. In at least one embodiment, when the theatre lighting device is in the first state, the external spectral sensor, takes a first measurement of the final light output.

The internal spectral sensor may be configured to take a second measurement of the residual light and the microprocessor may be programmed by computer software to act upon the operational software in memory to store the second measurement within the memory.

The theatre lighting device may be further comprised of a communications port; wherein the communications port is configured to gather the first input data from the external sensor first measurement and the microprocessor is programmed to cause the first measurement to be stored within the memory. The communications port may be a wireless communication port.

The microprocessor may be programmed by operational software stored in the memory to calibrate the first measurement with the second measurement.

The theatre lighting device may be comprised of a lamp housing; a base housing; and a spectral sensor; wherein the lamp housing is rotationally mounted to the base housing; wherein the lamp housing is comprised of a plurality of light sources, and a plurality of lenses; wherein the plurality of light sources and the plurality of lenses are configured to cooperate to project a final output light; wherein residual light is received by the spectral sensor from internal reflections created between a first lens and a second lens of the plurality of lenses; and wherein the residual light is converted to spectral data. The spectral sensor may be a multispectral filter array type.

The theatre lighting device may be further comprised of a microprocessor; a memory; and wherein the spectral data is stored within the memory. The theatre lighting device may further include a user interface comprising a visual display. The microprocessor may be configured to format the spectral data into pixel control information to be displayed on the visual display. The pixel control information may display hue and saturation information; color temperature information; International Commission on Illumination information; color rendering index information; and TM30 standard information.

In at least one embodiment, the theatre lighting device may be comprised of a lamp housing; a plurality of light sources; a plurality of lenses; and a spectral sensor; wherein the plurality of light sources and the plurality of lenses are configured to cooperate to project a final output light; and wherein residual light is received by the spectral sensor from the internal reflections created by a first lens of the plurality of lenses; wherein the spectral sensor is located within the lamp housing; and wherein the spectral sensor is fixed to the edge of the first lens of the plurality of lenses and wherein the spectral sensor is a multispectral filter array type.

In at least one embodiment, the theatre lighting device may be comprised of a lamp housing; a plurality of light sources; a plurality of lenses; a spectral sensor; a microprocessor; a memory; a user interface comprising a visual display; and a lens tube; wherein residual light is received by the spectral sensor from the internal reflections created between a first lens and a second lens of the plurality of lenses; wherein the spectral sensor converts the received residual light to spectral data; wherein the microprocessor is programmed to cause the spectral data to be stored in the memory; and wherein the visual display is configured to display the spectral data.

The first lens and second lens may be fixed within the lens tube. The residual light may be received by the spectral sensor passes through a port in the lens tube. The spectral data may be displayed as a visible spectral plot. The spectral data may be hue and saturation; color temperature; International Commission on Illumination chromaticity coordinates; color rendering index data; and TM30 standard data.

In at least one embodiment, the theatre lighting device may include a lamp housing; and a base housing, wherein the lamp housing is rotationally mounted to the base housing. The theatre lighting device may further include a plurality of light sources; a lens; a microprocessor; a memory; an output window; a spectral sensor; and a user interface comprising a visual display. The plurality of light sources, the lens, and the output window are configured to cooperate to project a final output light. The residual light may be received by the spectral sensor from the internal reflections created by the output window. The spectral sensor may convert the residual light to spectral data. The memory may store a first set of data for controlling a plurality of electronically adjustable parameters for the theatre lighting device; wherein the microprocessor is programmed by computer software to receive a first command and in response to the first command to cause the microprocessor to put the theatre lighting device in a first state in which the plurality of electronically adjustable parameters are set in accordance with the first set of data; and wherein the first set of data is a measurement of spectral data.

In at least one embodiment, the theatre lighting device is further comprised of a communications port; wherein the communications port receives spectral data from an external spectral sensor and wherein the microprocessor is programmed by computer software to store the spectral data in the memory.

DETAILED DESCRIPTION OF THE DRAWINGS

Figure 1:
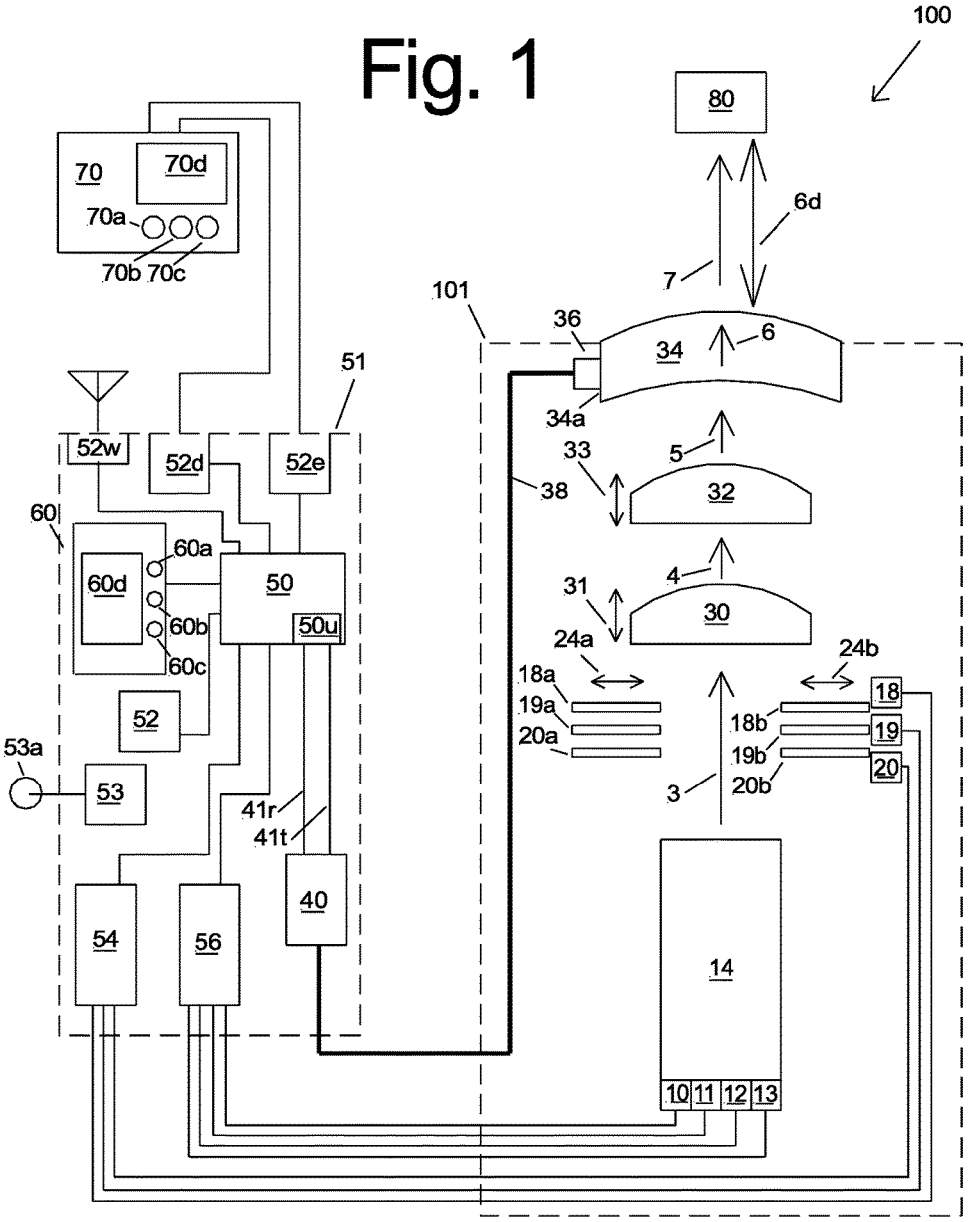
FIG. 1 shows a simplified block diagram of a theatre lighting device in accordance with an embodiment of the present invention.

FIG. 1 shows the theatre lighting device 100 of the present invention. Four light sources 10, 11, 12 and 13 that may be light emitting diode light sources or laser light sources are coupled to a light integrating pipe 14. Light emitted by the light integrating pipe 14 travels in the direction of arrow 3 (the light path direction) and passes through a CMY color mixing system comprised of two cyan opposing flags 20*a* and 20*b*, two magenta opposing flags 19*a* and 19*b*, and two yellow opposing flags 18*a* and 18*b*. Motor 20 operates the cyan opposing flags 20*a* and 20*b* to be driven into the light path 3 in the directions of arrows 24*a* and 24*b* to vary the saturation of cyan. Motor 19 operates the magenta opposing flags 19*a* and 19*b* to be driven into the light path 3 in the directions of arrows 24*a* and 24*b* to vary the saturation of magenta. Motor 18 operates the yellow opposing flags 18*a* and 18*b* to be driven into the light path 3 in the directions of arrows 24*a* and 24*b* to vary the saturation of yellow.

The light from the light path as shown by arrow 3 is received by focus lens 30. Focus lens 30 then passes the light in the direction of arrow 4. A zoom lens 32 is shown. Light from the light path as shown by arrow 4 passes though the zoom lens 32 and continues on in the direction of arrow 5. A final output lens or window 34 is shown. Light from the light path as shown by arrow 5 passes into the final output lens or window 34 and travels inside 34 as shown by arrow or light path 6, then exits the final output lens 34 in the direction of arrow 7. An external spectrometer 80 intersects the output light path traveling in the direction of arrow 7.

Figure 2:
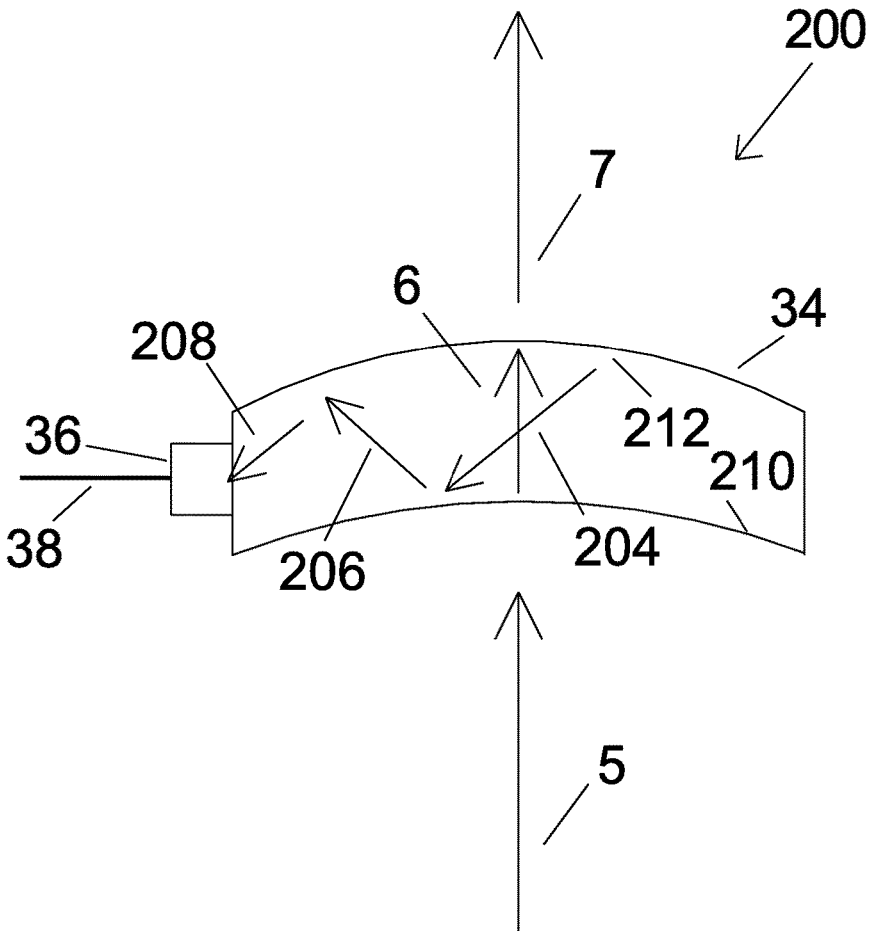
FIG. 2 shows a lens or output window of the theatre lighting device of FIG. 1.

The final output lens 34 has an optical coupler 36 fixed in any suitable way for collecting residual light from the lens edge 34*a* and for coupling a fiber optic cable 38. The fiber optic cable 38 receives residual light from the internal reflections propagated within the lens as shown in FIG. 2.

A lamp housing 101 shown by dotted line contains the various optical components as described above. A base housing 51 shown by dotted line contains the various electronic and power components as will be described. The lamp housing 101 may rotate or pan and tilt in relation to the base housing 51 by motors, a yoke, and bearings not shown here for simplification but is well known in the art of multiparameter theatre lighting. The lamp housing 101 is rotated in relation to the base housing 51 to allow the projected light 6 to be remotely projected upon different targets on a theatrical stage.

A spectral sensor 40 is shown connected to the fiber optic cable 38 for receiving the residual light supplied by the final output lens 34. The spectral sensor 40 can convert visible spectrum energy into data that is supplied to the microprocessor 50. The spectral sensor 40 of FIG. 1 or 304 of FIG. 6 may be comprised of linear image sensor such as part number ELIS-1024 by Panavision Imaging of Homer, N.Y. and an optical grating component known to be known as a grating spectromer. Another recent development in spectral sensors that the inventor has validated for use in the theater lighting device 100 as the internal spectral sensor is the multispectral filter array by AMS AG (trademarked) of Unterpremstatten, Austria as described at: http://ams.com/eng/Products/Spectral-Sensing/Multi-spectral-Sensing/AS7262 or http://ams.com/eng/Products/Spectral-Sensing/Multi-spectral-Sensing/AS7261. The AMS part number AS7262 and AS7261 is comprised of multispectral filter array (MSFA) deposited on a CMOS (complementary metal-oxide semiconductor) image sensor. A multispectral filter array is a plurality of interference filters deposited on a CMOS image sensor. The plurality of interference filters are comprised of six or more different spectral wavelengths in the visible spectrum arranged at 40 nm full half width at maximum. It is preferred for the internal sensor 40 of FIG. 1 or 304 of FIG. 3 or 630 FIG. 6 to be a multispectral filter array sensor that provides for better selectivity of color, small size and low cost.

The microprocessor 50 is connected to the light source electronic drivers 56 that control the amount of electrical energy separately and independently to the light sources 10, 11, 12 and 13. The microprocessor 50 is connected to a motor driven electronic supply 54 that drives the motors for the theatre lighting device 100 including the CMY color mixing system motors 18, 19 and 20. The microprocessor 50 is also connected to an electronic memory 52 that stores the operational software, including any calibration software data, intensity data and spectral data. A user interface 60 is also connected to the microprocessor 50 and has a display screen 60*d* and user input buttons 60*a*, 60*b*, and 60*c*. A power input connection 53*a* is shown for receiving input power that may be AC (alternating current) or DC (direct current) and a power supply 53 converts the input power to the correct voltage for the electronic components necessary for the operation of the theatre device 100.

Three communication ports 52*d*, 52*e* and 52*w* are shown as described by U.S. Pat. No. 6,570,348 to Belliveau, which is incorporated by reference herein. Communication port 52*d* is compatible with the DMX standard as described https://en.wikipedia.org/wiki/DMX512 and communication port 52*e* is compatible with the Ethernet standard and may use the Artnet protocol as described at http://art-net.org.uk/ Communications port 52*w* is a wireless communication port and makes use of the Bluetooth wireless system https://www.bluetooth.com/ or a WLAN standard such as IEEE 802.11 as shown https://en.wikipedia.org/wiki/IEEE_802.11 or a wireless DMX standard such as W-DMX a shown http://wirelessdmx.com/!gclid=EAlalQobChMlkpy7397-S1glVnLXACh3gpguDEAAYAyAAEgL-qfD BwE One or all three of the communication ports 52*d*, 52*e* or 52*w* may support updates or uploads of the operating software contained in the memory 52 and may support receiving spectral data from the external spectrometer 80. The external spectral data received by communication ports 52*d*, 52*e* or 52*w* can be stored in the memory 52 and operated on by the microprocessor 50 and the operational software stored in the memory 52.

One or all three of the communication nodes 52*d*, 52*e* and 52*w* can connect to a central control system 70 for receiving commands for the operation of the theatre lighting device 100 by an operator, technician or lighting director. All three of the communication nodes 52*d*, 52*e* and 52*w* can support bidirectional communication so that the central controller 70 receives spectral information and light source intensity, as sensed by the spectral sensor 40 of FIG. 1 or 304 of FIG. 3*d* or 630 FIG. 6 as well as hours or operation and light source integrity as relayed by the microprocessor 50. The central controller 70 has a display screen 70*d* for displaying spectral and intensity information and user input keys 70*a*, 70*b* and 70*c* for inputting commands to send to the theatre lighting device 100 by input from a technician.

The external spectrometer 80 which is not an attached component of the theater lighting device 100 measures the spectral qualities (including spectral information and intensity information) of the light emitted in path 6 from the output lens or output window 34.

FIG. 2 shows the lens or output window 34 receiving the light rays from the light path shown in the direction of arrow 5, passing inside the lens or output window 34 in the direction or arrow 6, and passing the light rays out of the lens or output window 34 in the direction of arrow 7. Arrow 204 shows an example light ray reflecting off the first internal lens surface 212 then travelling or propagating towards the second internal lens surface 210. Arrow 206 shows a light ray reflecting off the internal lens surface 210, due to the light ray represented by arrow 204, and then travelling or propagating towards the internal lens surface 212. Arrow 208 shows a light ray reflecting off the internal lens surface 212, due to the light ray represented by arrow 206, and entering the fiber optic coupler 36 that is mounted to an edge of the lens 34. The residual light rays, such as including a light ray represented by arrow 208, enter the fiber optic coupler 36 and are routed to the fiber optic cable 38 for transmission to the spectral sensor 40. The spectral sensor 40 may be located in the base housing 51 or may be located in the lamp housing 101. The spectral sensor 40 is connected by a bidirectional bus shown as 41*r* and 41*b* of FIG. 1 to a UART (universal asynchronous receiver-transmitter) 50*u* of the processor 50. It is important to have both received and transmitted data to the sensor 40 or sensor 304 or sensor 630. The transmitted data to the sensor 40 or sensor 304 or sensor 630 is used to provide command sets to control various parameters of the particular sensor of 40, 304, or 630. The properties of internal reflection are known to the art of photonics and the presently disclosed collection of residual light by properties of internal reflection provides several advantages such as no relevant light is lost to a sensor in the center of the lens 34, the residual light collected by the spectral sensor 40 is also homogenized because the residual light rays come from internal reflection and thus come from many sampling points. The collection of residual light by properties of internal reflection also does not create any artifacts to be seen in the final projected light of the theatre light 100.

Figure 3:
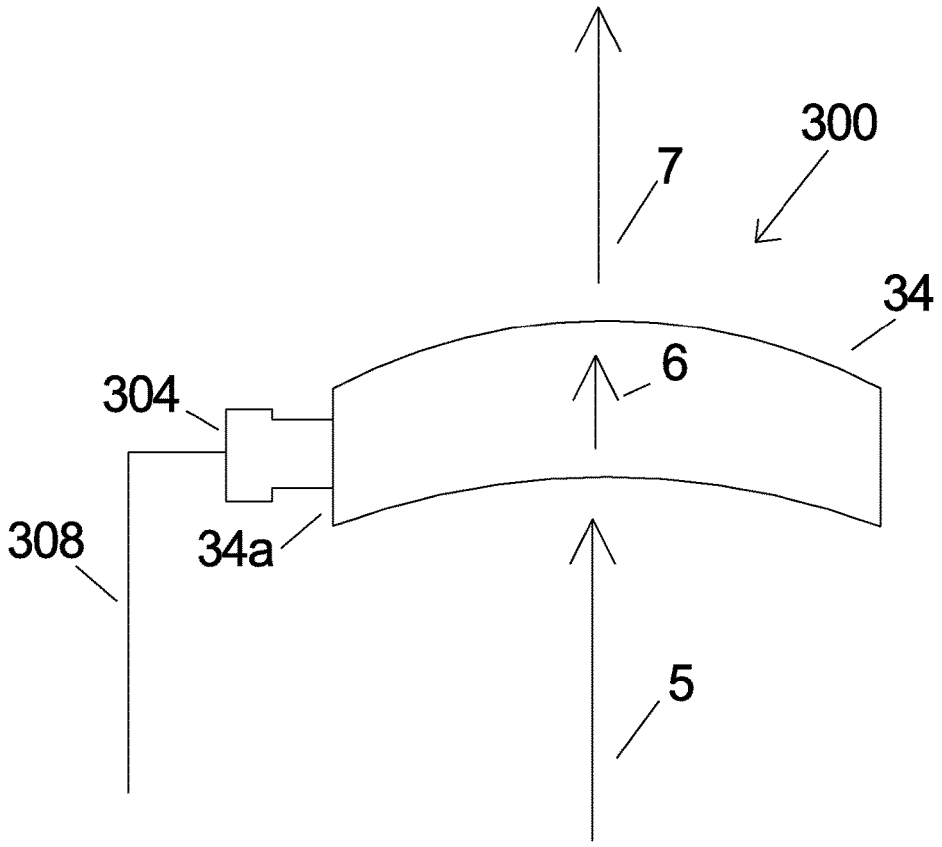
FIG. 3 shows a simplified diagram of an alternative method and apparatus of receiving residual light and in turn transmitting the data by a spectral sensor.

FIG. 3 shows a diagram 300 of an alternative method of receiving residual light and in turn transmitting the data by a spectral sensor by fixing a spectral sensor 304 to receive residual light from the side 34*a* of the lens or output window 34 instead of the fiber cable 38 and coupler 36 as in FIG. 2. The sensing of the residual light can be done through a fiber cable, light pipe, or directly with the spectral sensor 304. The data signal of the spectral sensor 304 may travel directly over the wiring 308 to the microprocessor 50. Spectral information that includes intensity may be stored in the memory 52 or shown on the display screen 60*d* of the user interface 60 of the data from the spectral sensor 304 may be transmitted to the central controller 70.

Figure 4:
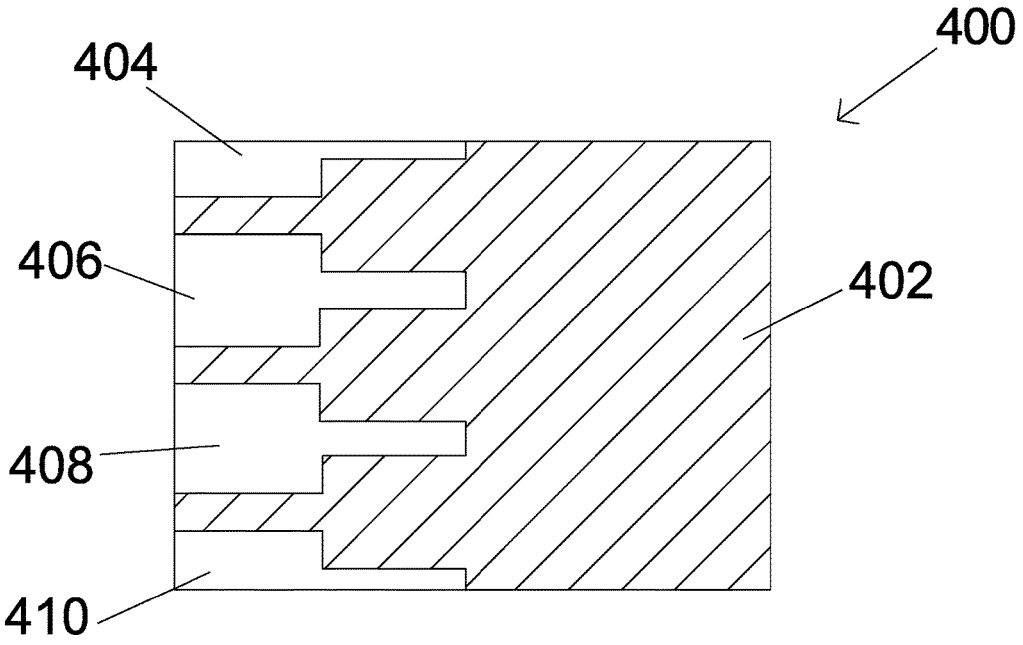
FIG. 4 shows a simplified diagram of a color mixing flag that is a variable density color filter.

FIG. 4 shows a color mixing flag that is a variable density color filter 400. The hatched area 402 is a transmissive color media that varies in density by reducing to small fingers 404, 406, 408, and 410. The color mixing flag 400 is constructed similarly to 18*a*, 18*b*, 19*a*, 19*b*, 20*a*, and 20*b*. Color mixing flags 18*a* and 18*b* are comprised of yellow color media and are driven to variably intersect the light path 3 in the directions of arrows 24*a* and 24*b* respectively by motor 18 that receives control signals from the motor control circuit 54 and the microprocessor 50 operating from the operational software stored in the memory 52. Color mixing flags 19*a* and 19*b* are comprised of magenta color media and are driven to variably intersect the light path 3 in the direction of arrows 24*a* and 24*b* respectively by motor 19 that receives control signals from the motor control circuit 54 and the microprocessor 50 operating from the operational software stored in the memory 52. Color mixing flags 20*a* and 20*b* are comprised of cyan color media and are driven to variably intersect the light path 3 in the direction of 24*a* and 24*b* respectively by motor 20 that receive control signals from the motor control circuit 54 and the microprocessor 50 operating from the operational software stored in the memory 52.

Figure 5A:
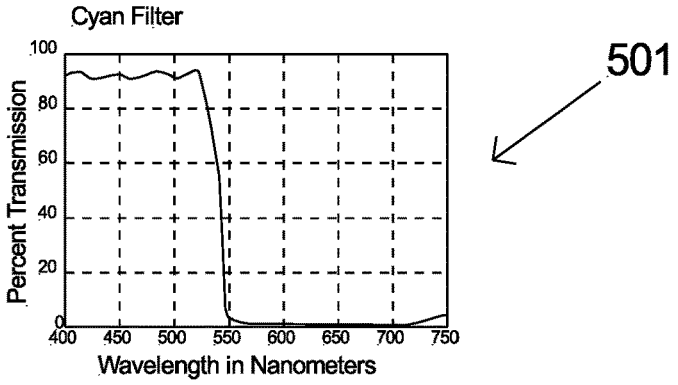
FIGS. 5A, 5B and 5C show percent transmission graphs in nanometers for of cyan, magenta and yellow color mixing flags, respectively, that can act to vary the color of the output light of the theater lighting device of FIG. 1.
Figure 5B:
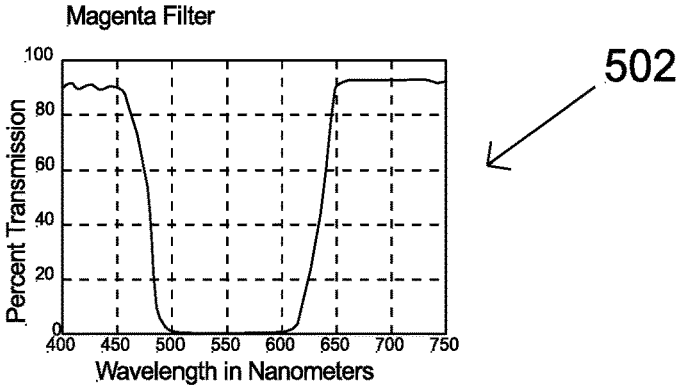
Figure 5C:
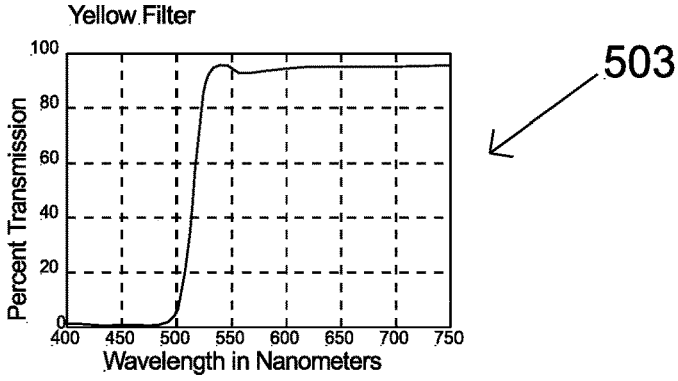

FIGS. 5A, 5B and 5C shows percent transmission graphs in nanometers for the cyan, magenta and yellow color mixing flags, respectively, that can act to vary the color of the output light of the theater lighting device 100 of FIG. 1. As any of the color mixing flag sets or pairs, cyan 20*a* and 20*b*, magenta 19*a* and 19*b*, and yellow 18*a* and 18*b* are driven into the light path as indicated by arrow 3 of FIG. 1 the saturation of cyan, magenta and yellow can be effectively varied.

Figure 6:
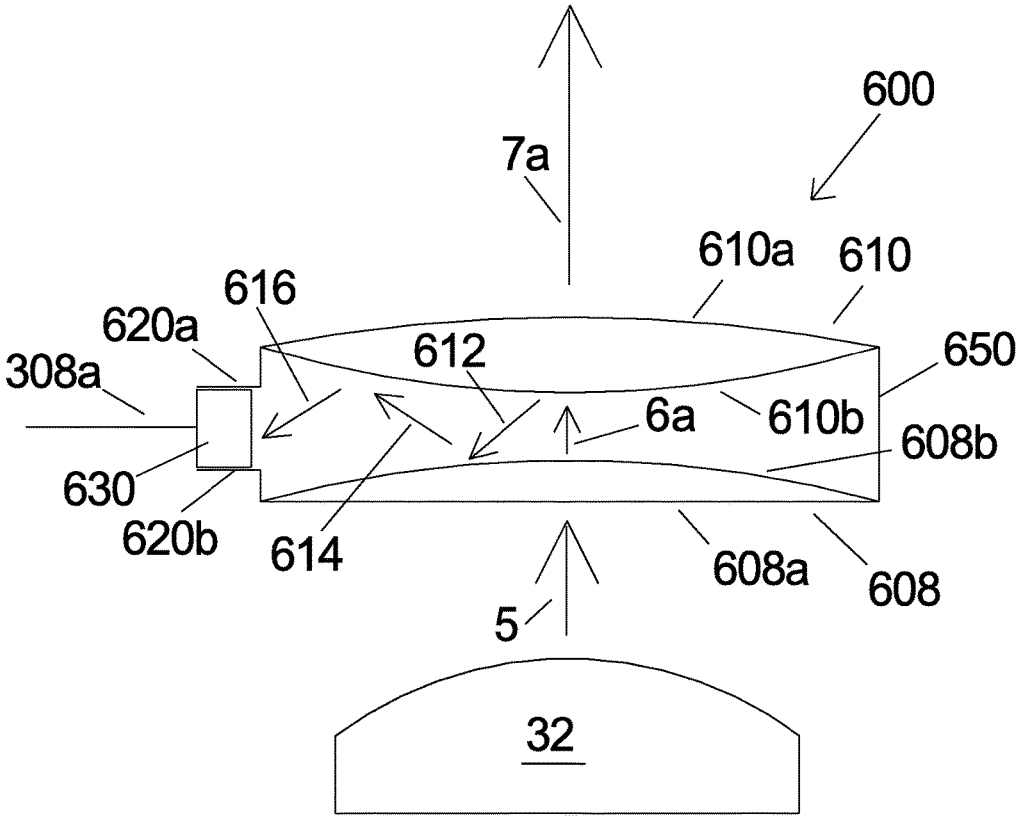
FIG. 6 shows a diagram in which a final output lens of FIG. 1 has been replaced by a plurality of final output lenses preferably mounted within a lens tube.

The inventor has discovered an additional method of capturing residual light by an internal reflection as shown by FIG. 6. In FIG. 6 the final output lens 34 of FIG. 1 has been replaced by a plurality of final output lenses 608 and 610 preferably mounted within a lens tube 650. The lens tube 650 is also comprised of a port 620*a* and 620*b* that is an opening in the lens tube 650 where a spectral sensor 630 is mounted within. The light path as shown by arrow 4 (which is the same light path 4 of FIG. 1 passes light to the zoom lens 32. The light path exits the zoom lens 32 in the direction of arrow 5 towards the final output lenses or output lens system passing through the first surface 608*a* of lens 608 and then exiting the second surface 608*b* and travels as shown by arrow 6*a* toward lens or output window 610. The light path shown by arrow 6*a* travels through the first surface 610*b* of lens or output window 610 and passes though second surface 610*a* in the direction of arrow 7*a*. Residual light from the light path 6*a* also reflects from first surface 610*b* and is reflected back to second surface 608*b*. Arrow 612 shows residual light being reflected from first surface 610*b* and towards second surface 608*b*. Arrow 614 shows residual light being reflected from second surface 608*b* and toward first surface 610*b*. Arrow 616 shows residual light being reflected from first surface 610*b* and towards the opening port on the lens tube 650 formed as 620*a* and 620*b* and in the direction of the spectral sensor 630. The spectral sensor 630 can receive the internally reflected residual light collected from between the output lenses or windows 608 and 610 and transmit spectral and intensity data via an electrical conductor 308*a* that can be received by the microprocessor 50 of FIG. 1.

FIG. 1 one shows the light sources 10, 11, 12 and 13 input light into the light integrating pipe 14 and exits light in the direction shown by arrow 3. The path of the light shown by arrow 3 passes through the CMY color mixing flags 18*a*,

18*b*, 19*sa*, 19*b*, 20*a* and 20*b* where the color mixing flags can be driven into the light to vary the Color or Hue in the direction of arrows 24*a* and 24*b* respectively. The light from the light path as shown by arrow 3 passes though the focus lens 30 and the light path exits in the direction of arrow 4 and enters the zoom lens 32. The light exits the zoom lens 32 as shown in the direction of arrow 5 and passes inside the output lens or window 34 in direction of arrow 6, and through the output lens or window 34 and exits in the direction of arrow 7 as the final output light of the theatre lighting device 100.

The sensor 40 of FIG. 1 that receives residual reflected light or the sensor 304 of FIG. 3 or the sensor 630 of FIG. 6 that receives residual reflected light, receives a reasonably homogenized light since the received residual light is comprised of multiple internal reflections. The sensor 40 or sensor 304 or sensor 630 is further referred to as an internal spectral sensor. The residual light collected by the internal spectral sensor can be less than one tenth the final output light that can be measured by the external spectral sensor 80. The internal spectral sensor 40 or sensor 304 or sensor 630 is located out of the optical path as shown by arrows 3, 4, 5, 6 and 7 of FIG. 1 so as to avoid artifacts being seen by a user of the theatrical lighting device 100.

The internal spectral sensor 40 of FIG. 1, 304 of FIG. 3 or the sensor 630 of FIG. 6 receives important command sets that allow the sensor to be controlled from the processor 50. One of the commands sets the processor 50 sends to the internal sensor is the control of gain. Gain control allows the internal spectral sensor 40 to be adjusted for best accuracy based upon the light intensity conditions of the light sources 10, 11, 12 and 13. The processor 50 should also receive temperature data from the internal spectral sensor 40 and the operational code stored in the memory 52 can instruct the processor 50 how to interpret spectral sensor measurement deviation based upon temperature conditions. It is known in the electronics art that changes to sensing devices operating temperatures can affect the accuracy of their measurements.

Figure 10:
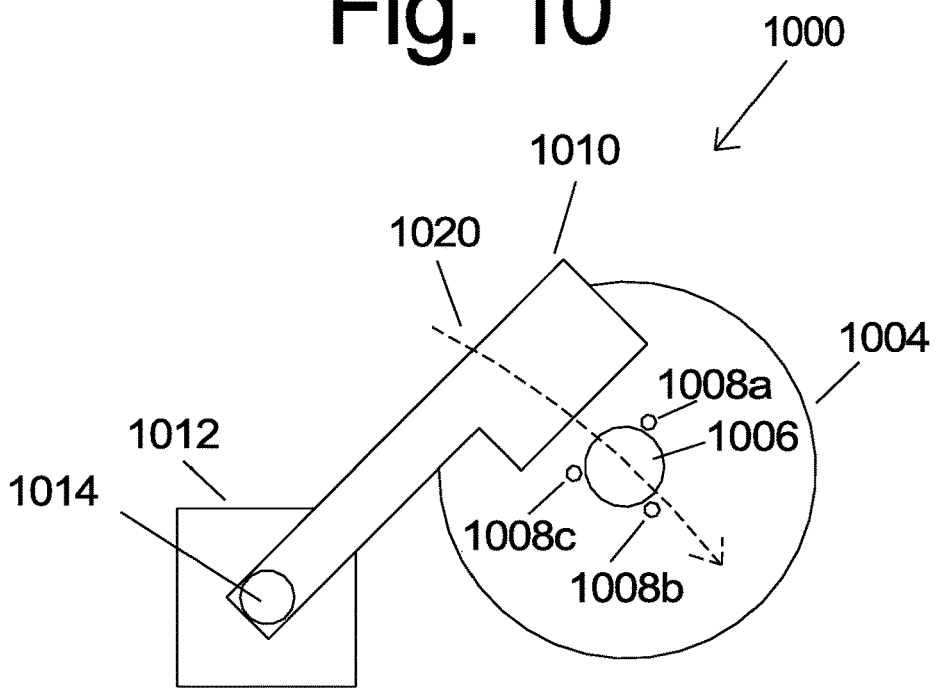
FIG. 10 shows a close up of an internal spectral sensor system that comprises an internal spectral sensor that incorporates a motor driven shutter blade system, with a shutter in an open state.

To increase the accuracy of the internal spectral sensor 40, sensor 304, or sensor 630 when the theatre lighting device is located in high ambient conditions such as an outdoor event a shutter system for the sensor can be employed. The sensor can be equipped with a light source or a plurality of light sources operating at a specified spectral wavelengths that set the internal spectral sensor 40, 304, or 630 into a known condition. FIG. 10 shows a close up of an internal spectral sensor system 1000 that comprises an internal spectral sensor 1004 that incorporates a motor driven shutter blade system. The Internal spectral sensor shutter system 1000 can be applied to internal spectral sensor 40, internal spectral sensor 304 or internal spectral sensor 630. The internal spectral sensor 1004 is shown with a light sensing aperture 1006. Three light sources are shown 1008*a*, 1008*b* and 1008*c* that may be light emitting diode light sources that are of specified spectral wavelengths that closely surround the sensor sensing aperture 1006. A shutter 1010 shown in an open state in FIG. 10 is driven to rotate in the direction of dotted line arrow 1020 to block the light sensing aperture 1006 of the spectral sensor 1004 by motor or actuator 1012 as motor shaft 1014 rotates. The shutter 1010 can be manufactured of a reflective or non-reflective substrate.

Figure 11:
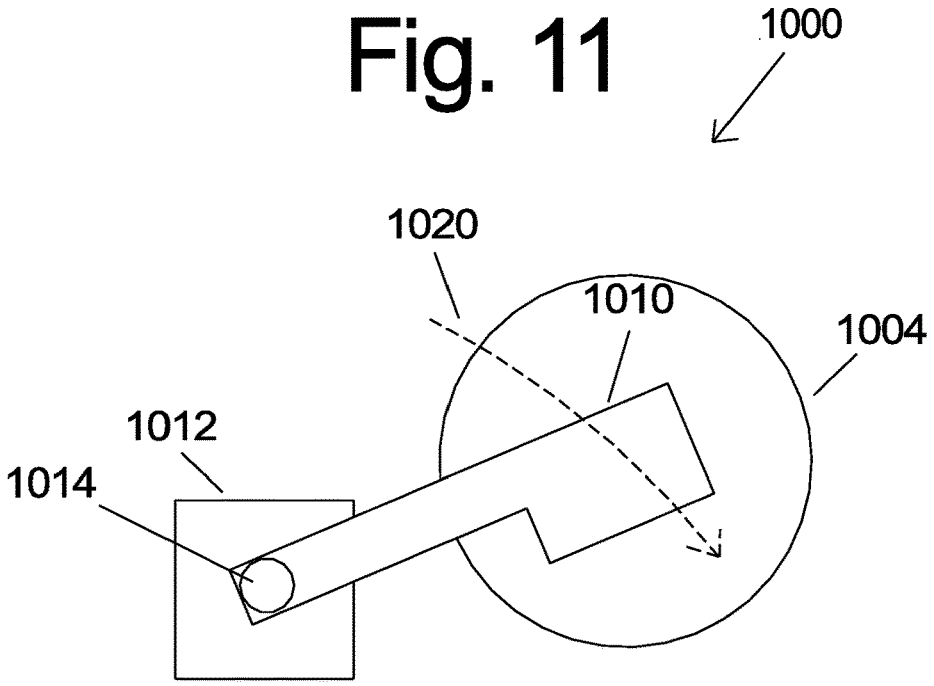
FIG. 11 shows the shutter system of FIG. 10 in a closed state as shown by the different orientation of the shutter of FIG. 10.

FIG. 11 shows the same shutter system 1000 of FIG. 10 in a closed state as shown by the different orientation of shutter 1010. The shutter 1020, in FIG. 11 has been moved in the direction of dotted arrow 1020 to cover the light sensing aperture 1006 of FIG. 10 by the rotation of motor shaft 1014 by motor 1012. When the shutter 1010 covers the light sensing aperture 1006 the spectral sensor 1004 can be put in one of two states. In a first state the light sources 1008*a*, 1008*b* and 1008*c* are not illuminated so the spectral sensor or system 1004 is in a dark state. In a second state the light sources 1008*a*, 1008*b* and 1008*c* are illuminated and reflected light from the back side of the shutter 1010, which illuminates the light sensing aperture 1006. In this way the internal spectral sensor or system 1000 can be put into three different states if required. A first state that is a dark state, a second state that is a controlled light state that provides an illumination condition as supplied by the specified spectral wavelengths of the light sources 1008*a*, 1008*b*, and 1008*c* and a third state with the shutter 1010 open as illustrated by FIG. 10, for sensing the residual light from the light sources 10, 11, 12 and 13 of FIG. 1.

The driving action of the shutter motor or actuator 1012 of FIG. 10 and FIG. 11 may be driven by the motor driving circuit 54 (control wiring not shown for simplification) and controlled by the microprocessor 50 and the operational software stored within the electronic memory 52. The light sources 1008*a*, 1008*b* and 1008*c* can also be controlled to illuminate by the light source driver 56 (control wiring not shown for simplification) and controlled by the microprocessor 50 and the operational software stored within the electronic memory 52. Commands to control the shutter 1010 and the light sources 1008*a*, 1008*b* and 1008*c* can be accomplished by a technician inputting to the user interface 60 by inputting at the user input buttons 60*a*, 60*b* or 60*c* or a technician imputing to the central controller 70 by inputting to the user input keys 70*a*, 70*b* and or 70*c*.

The shutter 1010 may be a shutter blade as shown in FIG. 10 or alternatively the shutter could be an iris type shutter.

The internal spectral sensor 40 of FIG. 1, 304 of FIG. 3 or the sensor 630 can communicate to the UART 52 of processor 50 by means of serial communication such as the RS232 communication standard using AT (Attention) instructions or alternatively an I2C (I-squared-C) command bus, Because the theatre light 100 has various optical components such as focus lens 30, zoom lens 32, CMY color mixing flags 18*a*, 18*b*, 19*a*, 19*b*, 20*a* and 20*b* that can vary their position in the light path and light sources 10, 11, 12, 13 and 14 that can vary their intensity, the theatre lighting device 100 has multiple variable parameters. It is necessary to establish a first predetermined state (position and/or intensity) for the variable parameters for a pre-optimized measurement of the visible spectrum and intensity of the final output light as indicated in the direction of arrow 6 and measured by the external sensor 80. The first predetermined state is stored in the memory 52. The first state places and/or sets levels of the parameters of the theatre light 100 to the first predetermined state. A first command to set the variable parameters of the theatre lighting device 100 to the first predetermined state can be issued by the technician by inputting to the user interface 60 by inputting at the user input buttons 60*a*, 60*b* or 60*c*. A first command to set the first predetermined sate can be issued by the technician by inputting to the central controller 70 by inputting to the user input keys 70*a*, 70*b* and or 70*c*. The theatre light 100 can be placed into the first state at any time before or during operation by a technician so that a measurement by either the internal spectral sensor 40 of FIG. 1 or 304 of FIG. 3 or 630 FIG. 6 or external sensor 80 may be realized in the first predetermined state.

When the theatre lighting device 100 is in the first state, the external sensor 80 can be used to measure the spectrum and intensity of the exiting light at a predetermined distance shown by arrow 6*d* of FIG. 1 The intensity measurement is referenced in Lux or Foot Candles as known in the art. When the theatre lighting device is in the first state and is new and operating correctly the pre-optimized measurement of the spectrum and intensity by the sensor 80 is exported as data and is imported to the memory 52 of the theater lighting device 100. The term "pre-optimized" refers to the spectral and or intensity measurement of the theatre lighting device 100 final light output before limiting any intensity of the light sources 10, 11, 12 and 13 or inserting any color mixing flags 18*a*, 18*b*, 19*a*, 18*b*, 20*a* and 20*b* into the light path. The importation of the pre-optimized spectral and or intensity data to the memory 52 may be by way of the communication ports 52*e*, 52*d* or 52*w* or any suitable means including loading of the operation code in the memory 52 during manufacture.

With the theater lighting device 100 in the first sate the internal sensor 40 of FIG. 1 or 304 of FIG. 3 or 630 FIG. 6 provides the measured residual spectrum and or intensity information to the microprocessor 50 to be stored in the memory 52. In this way the microprocessor 50 calculates a ratio or multiple ratios using an algorithm or lookup table between the external sensor data and the internal sensor data stored in the memory 52. An external spectral sensor such as sensor 80 can be used to calibrate each internal sensor of each one of multiple theatre devices 100 in a production setting.

With the internal sensor 40 of FIG. 1 or 304 of FIG. 3 or 630 FIG. 6 sensor output data calibrated by the external sensor 80 (the calibrated data can be referred to as post-optimized data) meaningful pre-optimized and post-optimized spectral and or intensity data contained in the memory 52 can be formatted to a particular format by the microprocessor 50 by instruction of operational software and sent as pixel control information to the user interface display 60*d* to be viewed by the technician upon a first spectral and or intensity enquiry command input by the input keys 60*a*, 60*b* and or 60*c* of the user interface 60 Some examples of spectral and or intensity display information displayed on the visual display screen 60*d* to the technician can be Hue and Saturation, Intensity (Illuminance), Color Temperature, Color Rendering Index (CRI), a visible spectral plot of the visible spectrum, TM30 standard as developed by the Illuminating Engineering Society (IES) and or International Commission on Illumination (CIE) chromaticity coordinates. Alternatively a technician can input spectral and or intensity first enquiry commands using the user input keys 70*a*, 70*b* and or 70*c* of the external central control system 70 and view the results of the pre-optimized spectral and or intensity on the visual display screen 70*d*. The spectral and/or intensity data information contained in the memory 52 can be transmitted by one of the communication ports 52*d*, 52*e*, or 52*w* to be received by the central controller 70 wherein the central controller processes the data and converts the data into various formats to be displayed on the display screen 70*d*. Communications ports 52*d*, 52*e* and 52*w* may use the Remote Device Management (RDM) electronic protocol by defining spectral and or intensity data message sets to send the spectral and or intensity data to be received by the central controller 70. The Remote Device Management electronic protocol is lighting protocol that supports sending service information data to the central controller and specifics can be found here http://www.rdmprotocol.org/. Some examples of spectral and or intensity display information formats displayed on the visual display screen 70*d* to the technician can be Hue and Saturation, Intensity (Illuminance), Color Temperature, Color Rendering Index, a visible spectral plot of the visible spectrum, TM30 as developed by the Illuminating Engineering Society (IES) and or International Commission on Illumination (also called Commission Internationale de l'Eclairage) (CIE) chromaticity coordinates.

During the production and manufacturing of the theatre lighting device 100 it may be found that the pre-optimized spectral and or intensity from a first theatre lighting device 100 in the first state does not meet a predetermined specification of spectral and or intensity characteristics compared to other theatre lighting devices of the same type as theater lighting device 100. A technician may determine that one or more intensities of the light sources 10, 11, 12 or 13 may need to be adjusted to meet the predetermined spectral and or intensity manufacturing requirements when the theatre lighting device 100 is placed into the first state. This can be accomplished by the technician entering into an editing mode for the theater lighting device 100 by either inputing.to the user interface 60 and using input keys 60*a*, 60*b* and or 60*c* or alternatively entering into an editing mode by sending edit commands by the central controller 70 input keys 70*a*, 70*b* and or 70*c*. Once the edit mode is realized by the theatre lighting device 100 the technician can adjust the intensity of any individual the light source 10, 11, 12 or 13 in the first state of the theatre lighting device 100 and commit that adjustment to the memory 52 to be realized as an optimized second state. Another alternative way to realize a predetermined spectral and or intensity optimized second state for the theatre lighting device 100 is the mechanical adjustment of the CMY color system. The entering of an edit mode for the CMY mechanical color mixing system is similar to the entering of the edit mode for control of the light intensities of the light sources. The Y (yellow) color mixing flags may alternatively be color corrector flags comprised of correct to orange (CTO) filter media that acts as a color correction system.

Figure 7:
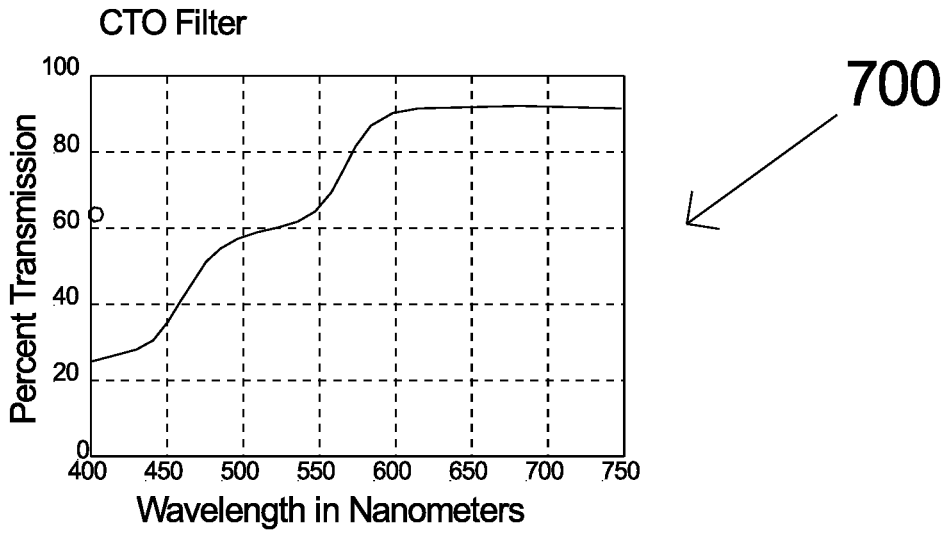
FIG. 7 shows a percent transmission graph in nanometers for a correct to orange (CTO) filter.

FIG. 7 shows a percent transmission graph 700 in nanometers for a correct to orange (CTO) filter. During the use of the edit mode to determine a spectral and or intensity optimized second state the technician may adjust one or more pairs of the Cyan or Magenta or Yellow flags into the light path 3 until a predetermined spectral and or intensity second state is realized. Another method of placing the theatre light 100 into a second optimized spectral and or intensity state from the first pre-optimized state is for the desired predetermined spectral and or intensity values to be stored in the memory 52 as part of the operational software. The microprocessor 50 under direction of the operational software compares the pre-optimized data from the sensor 80 and automatically makes the necessary intensity adjustments to the light sources 10, 11, 12 and 13 or alternatively the mechanical adjustments to the CMY system to bring the theatre lighting device 100 into compliance with the predetermined spectral and or intensity values. Once the microprocessor has automatically made the adjustments to the light source intensities and or the mechanical CMY system to bring the theatre lighting device to the predetermined spectral and or intensity values the theatre light 100 can be operated in the optimized second state.

The theatre lighting device counts hours of operation as known in the art. The theatre lighting device 100 of the invention should store initial spectral and or intensity data (for example within the first few hours of operation) as provided by the internal sensor 40 or 304 or 630 and the theatre device 100 at intervals compare the spectral and or intensity data with the current spectral and or intensity data as provided by internal sensor 40 or 304 or 630. In this way if the theatre lighting device 100 has determined by monitoring it's spectral and or intensity data that one or more of the light sources 10, 11, 12 and 13 are failing by unexpected color shift or low intensity as compared to the initial spectral and or intensity data a service message can be displayed on visual display screen 60*d* of user interface 60 or visual display screen 70*d* of central controller 70.

After adjustment to an optimized second state that has been saved in the memory 52 the theatre lighting device can be operated in the normal manner of creating theatre shows. It is also good to have a third pre-optimized operational state that temporarily by a command "releases" the optimized settings of the light sources 10, 11, 12 and 13 or any optimizing position of the CMY color flag positions or CTO position to allow the theatre lighting device 100 to maximize its light output. Commands therefor excepted by the theatre lighting device are:

1) Operate in the first pre-optimized state to the allow external measurement of a an external spectral sensor 80
2) Operate in a second optimized state that is also a normal operation of the theatre lighting device 100
3) Operate in a third pre-optimized state for maximum light output.

Any of the above three commands can be received by any of the communications ports 52*d*, 52*e*, and 52*w* and acted upon by the theatre lighting device 100. Also a technician may also enter commands by inputs to the user interface 60 such as input keys 60*a*, 60*b* or 60*c*.

The memory 52 also has the stored data of optimized spectral and or intensity information. The optimized spectral and or intensity information can be sent to the central controller upon initial power up or startup of the theatre light 100 by any of the communication ports 52*d*, 52*e* or 52*w*. In this way the optimized data sent to central controller can allow the central controller to create an optimized control surface. For example if theatre light 100 has only one light source that may be a white LED light source and CMY color mixing the control surface of the central controller can be set up for white LED light source and CMY color mixing attributes. The spectral characteristics and or intensity data of the white LED light source and the spectral characteristics of the CMY color mixing flags can also be sent to the central controller 70. This allows the central controller to create an accurate display of the available color space on the display 60*d* or report to the operator the CRI (color rendering index) or TM30 data values on the display 60*d*.

Figure 8:
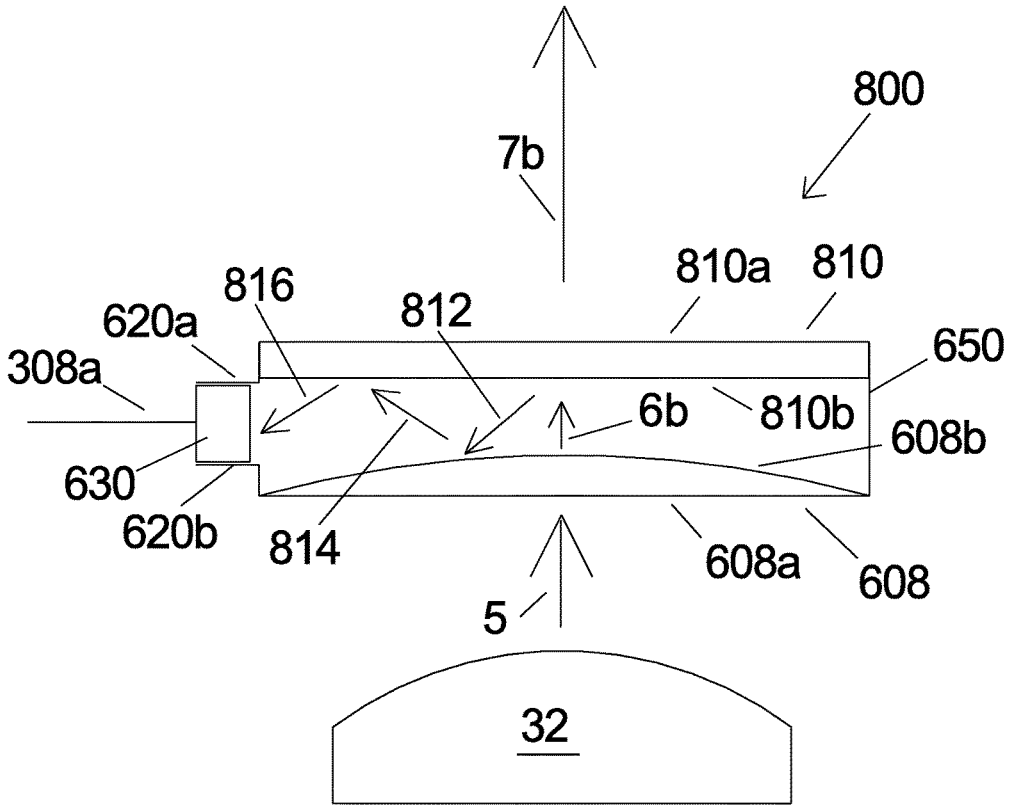
FIG. 8 shows a diagram in which a final output lens of FIG. 1 has been replaced by an output window and a lens preferably mounted within a tube.

FIG. 8 shows a diagram 800 in which a final output lens of FIG. 1 has been replaced by an output window 810 and a lens 608 preferably mounted within a tube 650. FIG. 8 shows essentially the same operation as FIG. 6 except that the lens 610 has been replaced with an output window 810. FIG. 8 shows lens surface 608*a*, 608*b*, lens 608, tube 650, components 620*a* 620*b*, and 630, and light ray 5 as in FIG. 6. FIG. 8 also shows components 812, 814, 816 representing light or reflected light, which correspond to, but will be somewhat different from 612, 614, and 616 in FIG. 6, respectively, because light reflection will be different for the lens 610 of FIG. 6 versus the output window 810 of FIG. 8. FIG. 8 shows surfaces 810*a* and 810*b* of the output window 810. FIG. 8 shows output light 7*b*, and internal light 6*b* which will differ from output light 7*a* and internal light 6*a* of FIG. 6, due to different structure of output window 810.

Figure 9:
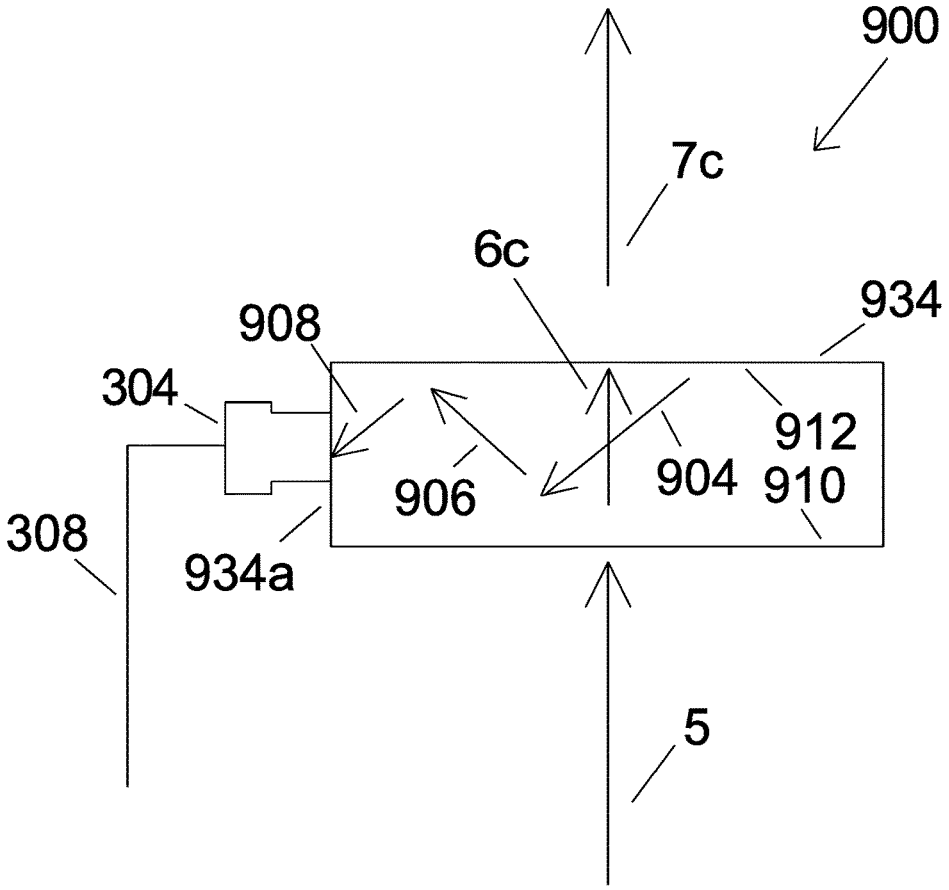
FIG. 9 shows a simplified diagram of an alternative method and apparatus of receiving residual light and in turn transmitting the data by a spectral sensor as in FIG. 3, except that a lens in FIG. 3 has been replaced with an output window.

FIG. 9 shows a simplified diagram 900 of an alternative method and apparatus of receiving residual light and in turn transmitting the data by a spectral sensor as in FIG. 3, except that a lens 34 in FIG. 3 has been replaced with an output window 934 in FIG. 9. In FIG. 9, the output window 934 has an edge 934*a*. FIG. 9, shows light, reflected light or light rays 904, 906, and 908. The output window 934 has internal surfaces 910 and 912. Internal light 6*c* and output light 7*c* will differ from internal light 6 and output light 7 in FIG. 3.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising
a theatre lighting device comprising:
a lamp housing;
a base housing;
and an internal spectral sensor;
wherein the lamp housing is rotationally mounted to the base housing;
wherein the lamp housing is comprised of a plurality of light sources, and a plurality of lenses wherein the plurality of light sources and the plurality of lenses cooperate to project a final output light; wherein residual light is received by the internal spectral sensor from internal reflections of a first lens of the plurality of lenses and the residual light is converted to spectral data by the internal spectral sensor.

2. The apparatus of claim 1 wherein
the internal spectral sensor is a multispectral filter array type.

3. The apparatus of claim 1 wherein the theatre lighting device is further comprised of:
a microprocessor; and
a memory;
wherein the memory stores a first set of data for a plurality of electronically adjustable parameters of the theatre lighting device;
wherein the microprocessor is programmed to receive a first command and in response to the first command to put the theatre lighting device in a first state in which the plurality of electronically adjustable parameters are set in accordance with the first set of data; and
wherein the apparatus is further comprised of an external spectral sensor which is external to the theatre lighting device; and
wherein when the theatre lighting device is in the first state, the external spectral sensor takes a first measurement of the final light output.

4. The apparatus of claim 3 wherein
the internal spectral sensor is configured to take a second measurement of the residual light and the microprocessor acts upon the operational software in memory to store the second measurement within the memory.

5. The apparatus of claim 4 wherein the theatre lighting device is further comprised of:
a communications port;
wherein the communications port is configured to gather a first input data from the external spectral sensor first measurement and the microprocessor is programmed to cause the first measurement to be stored within the memory.

6. The theatre lighting device of claim 5 wherein
the communications port is a wireless communication port.

7. The theatre lighting device of claim 5 wherein the microprocessor is programmed by operational software stored in the memory to calibrate the first measurement with the second measurement.

8. A theatre lighting device comprising
a lamp housing;
a base housing;
and a spectral sensor;
wherein the lamp housing is rotationally mounted to the base housing;
wherein the lamp housing is comprised of a plurality of light sources, and a plurality of lenses;
wherein the plurality of light sources and the plurality of lenses are configured to cooperate to project a final output light;
wherein residual light is received by the spectral sensor from internal reflections created between a first lens and a second lens of the plurality of lenses;
and wherein the residual light is converted to spectral data.

9. The theatre lighting device of claim 8 wherein the spectral sensor is a multispectral filter array type.

10. The theatre lighting device of claim 8 further comprising:
a microprocessor
a memory; and
wherein the spectral data is stored within the memory.

11. The theatre lighting device of claim 10 further comprising
a user interface comprising a visual display.

12. The theatre lighting device of claim 10 wherein the microprocessor is configured to format the spectral data into pixel control information to be displayed on a visual display.

13. The theatre lighting device of claim 12 wherein the pixel control information displays hue and saturation information.

14. The theatre lighting device of claim 12 wherein the pixel control information displays color temperature information.

15. The theatre lighting device of claim 12 wherein the pixel control information displays International Commission on Illumination information.

16. The theatre lighting device of claim 12 wherein the pixel control information displays color rendering index information.

17. The theatre lighting device of claim 12 wherein the pixel control information displays lighting color calculation procedure (TM30) standard information.

18. A theatre lighting device comprising:
a lamp housing;
a plurality of light sources;
and a plurality of lenses;
a spectral sensor;
wherein the plurality of light sources and the plurality of lenses are configured to cooperate to project a final output light;
wherein residual light is received by the spectral sensor from the internal reflections created by a first lens of the plurality of lenses;
wherein the spectral sensor is located within the lamp housing;
wherein the spectral sensor is fixed to the edge of the first lens of the plurality of lenses and wherein the spectral sensor is a multispectral filter array type.

19. A theatre lighting device comprising:
a lamp housing;
a plurality of light sources;
a plurality of lenses;
a spectral sensor;
a microprocessor;
a memory;
a user interface comprising a visual display; and
a lens tube; and
wherein residual light is received by the spectral sensor from the internal reflections created between a first lens and a second lens of the plurality of lenses;
wherein the spectral sensor converts the received residual light to spectral data;
wherein the microprocessor is programmed to cause the spectral data to be stored in the memory;
wherein the visual display is configured to display the spectral data.

20. The theatre lighting device of claim 19 wherein the first lens and second lens are fixed within the lens tube.

21. The theatre lighting device of claim 19 wherein the residual light received by the spectral sensor passes through a port in the lens tube.

22. The theatre lighting device of claim 19 wherein the spectral data is displayed as a visible spectral plot.

23. The theatre lighting device of claim 19 wherein the spectral data is hue and saturation.

24. The theatre lighting device of claim 19 wherein the spectral data is color temperature.

25. The theatre lighting device of claim 19 wherein the spectral data is International Commission on Illumination chromaticity coordinates.

26. The theatre lighting device of claim 19 wherein the spectral data is color rendering index data.

27. The theatre lighting device of claim 19 wherein the spectral data is lighting color calculation procedure (TM30) standard data.

28. A theatre lighting device comprising:
a lamp housing; and
a base housing, wherein the lamp housing is rotationally mounted to the base housing;
a plurality of light sources;
a lens;
a microprocessor;
a memory;
an output window;
a spectral sensor;
a user interface comprising a visual display;
wherein the plurality of light sources, the lens, and the output window are configured to cooperate to project a final output light;
wherein residual light is received by the spectral sensor from the internal reflections created by the output window;
wherein the spectral sensor converts the residual light to spectral data;
wherein the memory stores a first set of data for controlling a plurality of electronically adjustable parameters for the theatre lighting device; and
wherein the microprocessor is programmed by computer software to receive a first command and in response to the first command to cause the microprocessor to put the theatre lighting device in a first state in which the plurality of electronically adjustable parameters are set in accordance with the first set of data; and
wherein the first set of data is a measurement of the spectral data.

29. The theatre lighting device of claim 28 further comprising a communications port; and wherein the communications port receives the spectral data from an external spectral sensor and wherein the microprocessor is programmed by computer software to store the spectral data in the memory.

30. A theatre lighting device comprising:

a lamp housing; and a base housing, wherein the lamp housing is rotationally mounted to the base housing;

a plurality of light sources;

a plurality of lenses;

a memory;

an output window;

a spectral sensor;

a user interface comprising a visual display;

wherein the plurality of light sources and the plurality of lenses, are configured to cooperate to project a final output light;

wherein residual light is received by the spectral sensor from internal reflections;

wherein the spectral sensor converts the residual light to spectral data;

and wherein the spectral sensor in comprised of a plurality of interference filters.

31. The theatre lighting device of claim 30 wherein the plurality of interference filters are comprised of different spectral wavelengths in a visible spectrum arranged to forty nanometers full half width.

32. The theatre lighting device of claim 31 wherein the internal reflections are propagated from a first lens of the plurality of lenses.

33. The theatre lighting device of claim 30 wherein the internal reflections are propagated from between a first lens of the plurality of lenses and a second lens of the plurality of lenses.

34. The theatre lighting device of claim 30 wherein the internal reflections are propagated from the output window.

35. The theatre lighting device of claim 30 wherein the internal reflections are propagated from between the output window and a first lens of the plurality of lenses.

36. A method comprising projecting a final output light from a theatre lighting device by using a plurality of light sources and the plurality of lenses of the theatre lighting device; and receiving residual light by an internal spectral sensor, internal to the theatre lighting device, from internal reflections of a first lens of the plurality of lenses and converting the residual light to spectral data by use of the internal spectral sensor.

37. The method of claim 36 wherein the internal spectral sensor is a multispectral filter array type.

38. The method of claim 36 further comprising storing a first set of data including a plurality of electronically adjustable parameters of the theatre lighting device;

receiving a first command from a microprocessor and in response to the first command putting the theatre lighting device in a first state in which the plurality of electronically adjustable parameters are set in accordance with the first set of data; and using an external spectral sensor, which is external to the theatre lighting device, to take a measurement of the final light output.

39. The method of claim 36 further comprising taking a measurement of the residual light by using the internal spectral sensor; and storing the measurement of the residual light within a memory.

40. The method of claim 39 wherein the theatre lighting device is further comprised of:

a communications port;

wherein the communications port is configured to gather data regarding the measurement of the final light output and the microprocessor is programmed to cause the measurement of the final light output to be stored within the memory.

41. The theatre lighting device of claim 40 wherein the communications port is a wireless communication port.

42. The theatre lighting device of claim 41 further comprising calibrating the measurement of the final light output with the measurement of the residual light.

43. A method comprising projecting a final output light from a cooperation of a plurality of light sources and a plurality of lenses;

receiving residual light from internal reflections created between a first lens and a second lens of the plurality of lenses;

and converting the residual light to spectral data by use of a spectral sensor.

44. The method of claim 43 wherein the spectral sensor is a multispectral filter array type.

45. The method claim 43 further comprising:

storing the spectral data within a memory.

46. The method of claim 43 further comprising formatting the spectral data into pixel control information and displaying on the visual display.

47. The method of claim 46 wherein the pixel control information displays hue and saturation information.

48. The method of claim 46 wherein the pixel control information displays color temperature information.

49. The method of claim 46 wherein the pixel control information displays International Commission on Illumination information.

50. The method of claim 46 wherein the pixel control information displays color rendering index information.

51. The method of claim 46 wherein the pixel control information displays lighting color calibration procedure (TM30) standard information.

52. A method comprising projecting a final output light from a cooperation of a plurality of light sources and a plurality of lenses;

receiving residual light by a spectral sensor from internal reflections created by a first lens of the plurality of lenses;

wherein the spectral sensor is located within a lamp housing;

wherein the spectral sensor is fixed to the edge of the first lens of the plurality of lenses and wherein the spectral sensor is a multispectral filter array type.

* * * * *